United States Patent [19]

Brodwin

[11] 4,161,051

[45] Jul. 17, 1979

[54] CONTOURED HANDLE

[76] Inventor: Bernard Brodwin, 5 Barone Rd., West Orange, N.J. 07052

[21] Appl. No.: 788,821

[22] Filed: Apr. 19, 1977

[51] Int. Cl.[2] ..... B25G 1/10

[52] U.S. Cl. ..... 16/110 R; 145/61 R

[58] Field of Search ..... 16/110 R, 110 A, DIG. 12; 272/67, 68, 75, 143; 273/67 DA, 75, 81 R, 81 A, 81 B, 81 C, 81 D, 81.4; 145/29 R, 61 R

[56] References Cited

U.S. PATENT DOCUMENTS

| | | | |
|---|---|---|---|
| 346,858 | 8/1886 | Moss | 273/75 |
| 1,036,664 | 8/1912 | Marble | 145/61 R |
| 1,664,257 | 3/1928 | McCullough | 16/110 R |
| 2,060,924 | 11/1936 | Brewer | 52/716 |
| 2,086,974 | 7/1937 | Belfore | 16/110 R |
| 2,117,489 | 5/1938 | Madsen | 52/716 |
| 3,330,558 | 7/1967 | Simons | 272/68 |

FOREIGN PATENT DOCUMENTS

| | | | |
|---|---|---|---|
| 766468 | 1/1957 | United Kingdom | 16/110 R |

*Primary Examiner*—Louis Rimrodt

*Attorney, Agent, or Firm*—Carella, Bain, Gilfillan & Rhodes

[57] ABSTRACT

A contoured handle whose body has a length at least equal to the width of the palm of a human hand and which body has two protruding portions extending along the length of the body and wherein the body portions protrude in different directions from the longitudinal axis of the body, and wherein the direction of one body portion is at substantially a right angle with respect to the direction of the other body portion and wherein one of the body portions has a first recessed channel adapted to receive the thumb of a human hand and wherein the other body portion has a convexly curved surface adapted to occupy the partially enclosed space by circled fingers of the same human hand.

7 Claims, 7 Drawing Figures

CONTOURED HANDLE

BACKGROUND OF THE INVENTION

This invention relates generally to handles and, more particularly, to a new and improved contoured handle designed to provide a comfortable fit to the natural void created by an enclosed grip of the human hand.

Ever since the stone age man has used hand implements of one sort or another for a variety of purposes. Initially, the club, now popularly known as a police baton, was and is still used as a weapon. Through the ages man has designed a variety of hand implements to perform much more intricate tasks than those associated with the use of a weapon used for survival. Most of the hand implements designed by man through the ages have a generally circular cross-section due, most likely, to the fact that the first hand implements used by man were fallen branches or small saplings used to prod or poke. Since mother nature had provided the branches and saplings with the circular cross-section man continued the natural configuration even when he tied one across the end of the other to make an improved weapon and gain the benefit of mechanical leverage.

In more recent times, in addition to a wide assortment of tools, man has devised various sports requiring equipment such as bats, golf clubs, paddles, rackets, each having a generally circular cross-section.

The performance that a person can achieve from hand implements whether they are tools or sports equipment in large measure is related to how they interface or fit with his or her body. In the case of hand implements, the natural grip of the hand should provide good directional control, accuracy and stability, but yet provide a natural feel. Most devices with hand grips have a rounded or circular type cross-section or are straight sided and have a rectangular or polygonal type of cross-section. The former are naturally comfortable but suffer from poor directional control and stability, while the latter provide better directional control but are not comfortable, tending to fatique the muscles in the hand causing discomfort to the person.

It is an object of my invention to provide a comfortable contoured handle that also inherently because of its geometrical shape provides stable directional control.

SUMMARY OF THE INVENTION

In its broader aspects, the invention takes the form of a uniquely contoured handle designed to fill the natural void created by an enclosed hand.

In some of the more specific aspects of the invention, the contoured handle has an elongated body with a length at least equal to the width of the palm of a human hand. The body comprises two protruding portions extending along the length of the body and extending in different directions from the longitudinal axis of the body. One direction is oriented at substantially a right angle with respect to the other direction. One protruding portion has a first recessed channel adapted to receive the thumb of a human hand, while the other protruding portion has a convexly curved surface adapted to occupy the partially enclosed space created by curling the fingers of the same human hand.

In an alternative illustrative embodiment, the portion with the convexly curved surface has a recessed channel adapted to receive the forefinger of the hand with the curled fingers. The axis of the first recessed channel of this embodiment is at an angle with respect to the longitudinal axis of the body. This angle has a value in the range of 45 to 75 degrees.

BRIEF DESCRIPTION OF THE DRAWING

A more complete understanding of this invention including additional objects, features and advantages thereof will be more readily appreciated and better understood by reference to the following detailed description which should be considered in conjunction with the accompanying drawing in which:

FIG. 7 is a cross-sectional view taken along the line 7—7 in FIG. 5 in the direction of the arrows.

DETAILED DESCRIPTION

Before discussing the invention in detail, it is pointed out that the two illustrative embodiments to be described hereinafter are designed to mate with the right hand only because the majority of people are naturally right-handed. It is readily apparent that the following inventive principles equally pertain to left-hand contoured handles and that those skilled in the art may readily design and make same from the following description.

Figure 1:
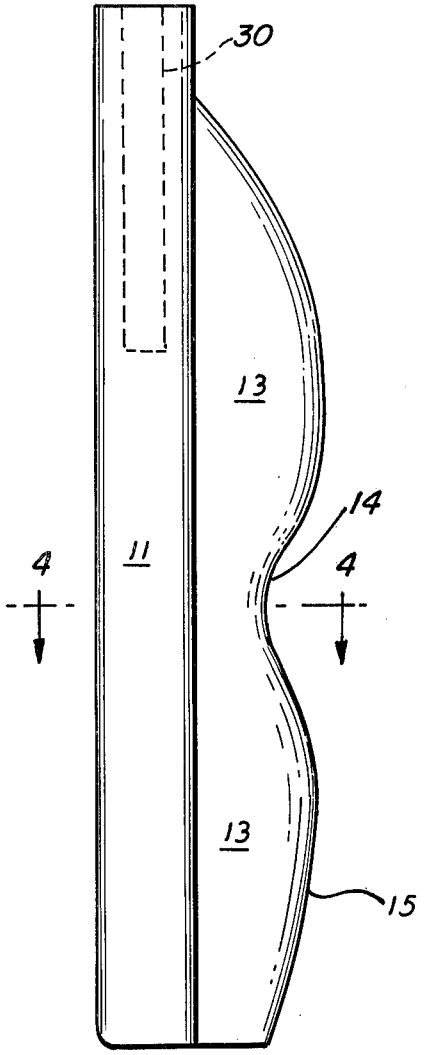
FIGS. 1, 2, and 3 are views from different rectangular perspectives of one illustrative hand grip embodying the features of this invention.

FIG. 1 is a one side view of an illustrative handle. The rectangular area 11 is an end view of a portion of the illustrative handle which protrudes out from the plane of FIG. 1. The double convexed shaped portion 13 of the illustrative handle generally extends in a rectangular direction in the plane of FIG. 1.

Present in portion 13 is recessed channel 14 which has a designed contour to provide a natural accommodation for the thumb of a right hand. Convex area 15 of portion 13 in FIG. 1 provides a contoured surface to accommodate the region of the palm of the right hand in the proximity of the base of the thumb. Portion 11 accommodates the space or partially enclosed void formed by curling the fingers of the right hand.

Figure 2:
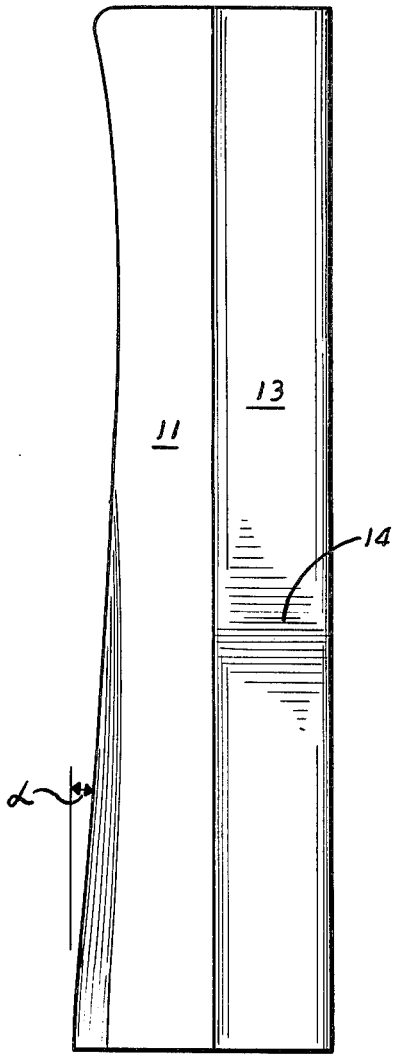

FIG. 2 depicts the end view of portion 13 and the side view of portion 11. Shown in FIG. 2 is an angle $\alpha$ made between the longitudinal axis of the illustrative handle and the curved surface of portion 11. This angle should have a value between 3 to 5 degrees to provide a natural fit to the human hand.

Figure 3:
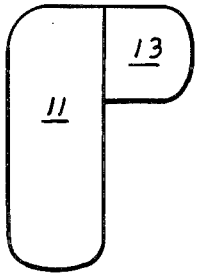

FIG. 3 illustrates the cross-sectional relationship between portions 11 and 13. The cross-sectional area of FIG. 3 is generally a modified "L" shape. Actually, this shape appears as an inverted "L" throughout the drawing because of the perspectives of the views.

Figure 4:
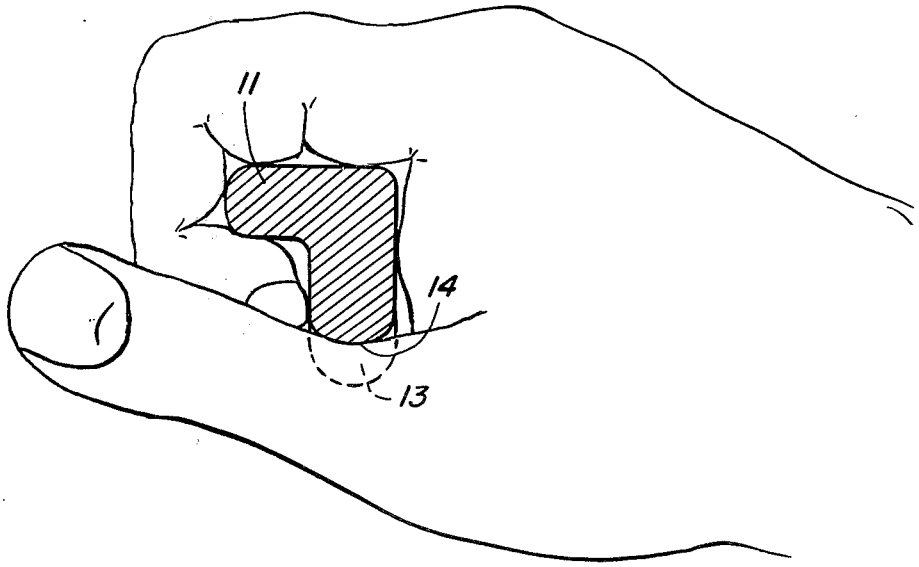
FIG. 4 is a sectional view which illustrates the manner in which the inventive handle occupies the natural void created by a grasping human hand.

FIG. 4 shows a cross-sectional view of the illustrative handle of FIGS. 1, 2, and 3 in the grasp of an enclosed right hand. This sectional view is taken along the line 4—4 of FIG. 1 and then rotated 90° in a clockwise direction. In general, the remainder of the implement of the illustrative handle in FIG. 4 may extend above or below the plane of FIG. 4 or in both directions at the same time. The illustrative handle fills the natural void provided by the curled fingers, palm, and thumb of a gripping or clutched right hand. It should also be observed from FIG. 4 that by filling the void the illustrative handle provides significant contact area or pressure bearing surfaces between the hand and the illustrative handle. This feature provides good control and directional stability of the implement associated with the illustrative handle. In other words, the position of the hand clutching the grip also controls the position of the implement associated therewith so that the latter can be viewed as a natural extension of the former.

The illustrative handle of FIGS. 1, 2, and 3 may be readily fabricated of any of a number of materials individually or in combination. For example, some of the typical materials that may be used, plastic, wood, metal, rubber, and leather. The inventive handle may be manufactured by any of a number of well known techniques, such as for example machining or molding. Of course, those skilled in the art, should consider materials which are consistent with the manufacture of the remainder of the implement in the case where the illustrative handle is an integral part. As is also apparent, the illustrative handle may be readily adapted to be affixed to associated devices or equipment. For example, the handle may be molded around an end portion of the shank 30 of a hammer or screwdriver or may be bonded thereto by a suitable adhesive or bonding agent; the shank 30 is illustrated in dashed outline in FIG. 1. In summary, the illustrative handle has numerous applications and those mentioned within this disclosure are only intended to be illustrative so that those skilled in the art may employ the inventive principles disclosed herein to their full advantage.

Figure 5:
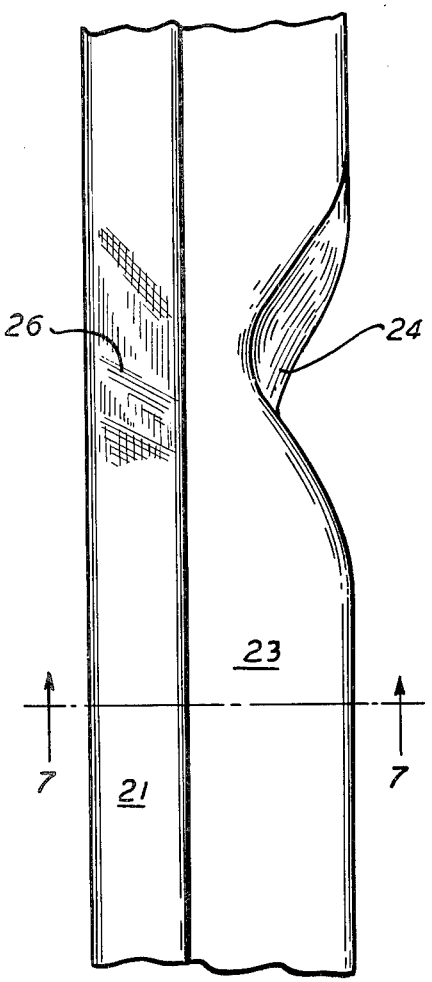
FIGS. 5, 6, and 7 are different views of another illustrative hand grip embodying the features of this invention.
Figure 6:
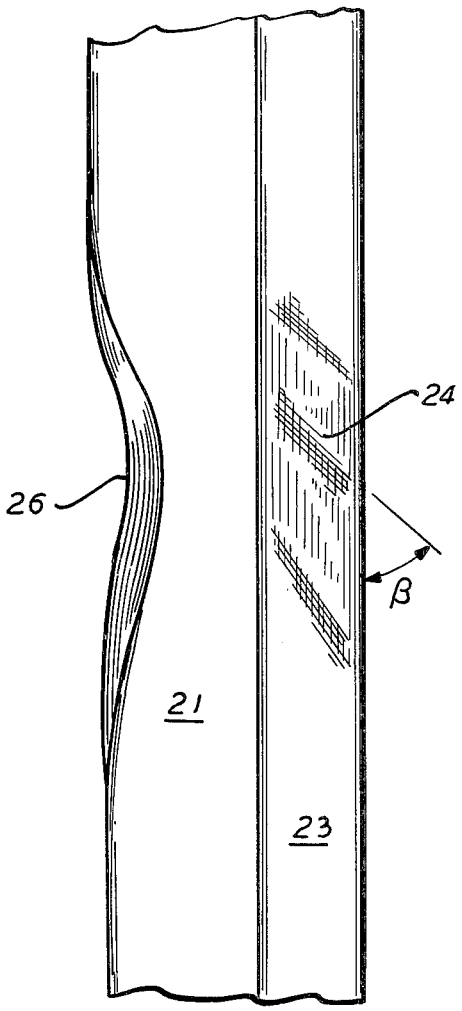
Figure 7:
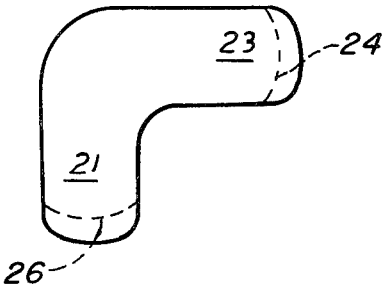

FIGS. 5, 6, and 7 provide similar perspective views of an alternate embodiment of the inventive handle.

In FIG. 5, portion 21 protrudes vertically from the plane of FIG. 5 and is therefore an end view. A side view is shown of portion 23. Shaded area 26 in portion 21 is a recessed channel which is adapted to receive the forefinger of a hand when grasping the illustrative handle of FIGS. 5, 6, and 7.

In FIG. 6, recessed channel 26 is shown from the side while a head on view is depicted of recessed channel 24. An angle B between the axis of recessed channel 24 and the longitudinal axis has a nominal value of approximately 60°. In practical handles, the value of B may range from 45° to 75° and still provide the advantages inherent to the illustrative handle. The feature associated with the angular position of the axis of recessed channel 24 for accommodating a thumb is to orient the thumb to a position immediately above the forefinger which is accommodated by recessed channel 26.

FIG. 7 depicts the relative orientations or protruding portions 21 and 23. It is again stressed that the illustrative handle of FIGS. 5, 6, and 7 is adapted for right-handed use but these inventive principles pertain equally to left-handed use.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as claimed.

What is claimed is:

1. A contoured handle having an elongated body having a length at least equal to the width of the palm of a human hand, said body having two protruding portions extending along the length of the body and said portions protrude in different directions from the longitudinal axis of the body, the direction of one portion is at substantially a right angle with respect to the direction of the other of said portions, one of said portions having a first recessed channel adapted to receive the thumb of a human hand, and the other of said portions having a convexly curved surface adapted to occupy the partially enclosed space by curled fingers of the same human hand.

2. A contoured handle in accordance with claim 1 wherein the portion with the convexly curved surface has a recessed channel adapted to receive the forefinger when said member is grasped by a human hand.

3. A contoured handle in accordance with claim 1 wherein the first recessed channel has an axis that forms an angle with the longitudinal axis having a value of 45 to 75 degrees.

4. A contoured handle longitudinally shaped to receive the width of a human hand comprising a body of a cross-sectional shape corresponding generally to the shape of the letter L, a first portion of the body protruding along the length of said body in a first direction, a second portion of the body protruding along the length of said body in a second direction oriented substantially rectangular to said first direction, one of said portions having a first recessed channel adapted to receive the thumb of a human hand, and the other of said portions having a rounded end surface extending along its length adapted to fill the partial void created by curled fingers of the same human hand.

5. A contoured handle in accordance with claim 4 wherein the first recessed channel has an axis that forms an angle with respect to the longitudinal axis of the handle having a value of 45 to 75 degrees.

6. A contoured handle in accordance with claim 5 wherein the portion having the rounded end surface has a recessed channel adapted to receive the forefinger of the human hand.

7. A contoured handle in accordance with claim 6 wherein said first recessed channel is deeper than the other recessed channel.

* * * * *